United States Patent [19]

Meister et al.

[11] Patent Number: 4,733,384

[45] Date of Patent: Mar. 22, 1988

[54] PERPETUAL CALENDAR WATCH HAVING TWO MOTORS

[75] Inventors: Pierre-André Meister, Bienne; Pierre Schmidli, Evilard; Bruno Erni, Bienne; Bertrand Soltermann, Diesse, all of Switzerland

[73] Assignee: ETA S.A. Fabriques d'Ebauches, Grenchen, Switzerland

[21] Appl. No.: 46,349

[22] Filed: May 6, 1987

[30] Foreign Application Priority Data

May 26, 1986 [CH] Switzerland ..... 02109/86

[51] Int. Cl.[4] ..... G04B 19/24

[52] U.S. Cl. ..... 368/28; 368/37; 368/35

[58] Field of Search ..... 368/28, 37, 31, 33, 368/34, 35, 38

[56] References Cited

U.S. PATENT DOCUMENTS

| | | | |
|---|---|---|---|
| 4,232,510 | 11/1980 | Tamaru et al. | 368/28 |
| 4,266,288 | 5/1981 | Berney | 368/28 |
| 4,300,222 | 11/1981 | Nitta | 368/37 |
| 4,695,168 | 9/1987 | Meister et al. | 368/28 |

FOREIGN PATENT DOCUMENTS

| | | |
|---|---|---|
| 2353889 | 12/1977 | France . |
| 2394840 | 1/1979 | France . |
| 2404250 | 4/1979 | France . |
| 1590467 | 6/1981 | United Kingdom . |

OTHER PUBLICATIONS

Patents Abstracts of Japan, vol. 5, No. 64 (P-59)[736], 30 Apr. 1981; & JP-A-56 16 886 (Suwa Seikosha K.K.).

Patents Abstracts of Japan, vol. 5, No. 56 (P-57)[728], 17 Apr. 1981; & JP-A-56 8586 (Suwa Seikosha K.K.).

*Primary Examiner*—Bernard Roskoski

*Attorney, Agent, or Firm*—Pollock, Vande Sande & Priddy

[57] ABSTRACT

This invention is concerned with an analogue calendar watch able to display the hour, the day of the month perpetually, and whenever required, the number of the month via the day of the month display. The watch includes a first motor driving the time display in response to a time base signal, a perpetual calendar circuit including a day counter, a month counter and a year counter and receiving a daily signal supplied by a contact, a control circuit connected to the calendar circuit, and a second motor driving the day of the month display in response to a signal from the control circuit. The display of the number of the month is achieved with a reading circuit that receives from the calendar circuit signals representative of the contents of the day and month counters. The reading circuit issues to the second motor, in response to a month call signal, a control signal to change the day of the month being displayed to the number of the month, and a further control signal to move the day of the month display back to its original position.

5 Claims, 2 Drawing Figures

PERPETUAL CALENDAR WATCH HAVING TWO MOTORS

BACKGROUND OF THE INVENTION

1. Field of the Invention

This invention relates to an analogue electronic watch having a calendar and comprising two motors, one for driving the hour display means and the other for driving the day of the month display means. It is more particularly concerned with a watch which further comprises a perpetual calendar circuit. The object of such a circuit, which includes day, month and year counters, is to issue a signal to a control circuit so as to cause the control circuit to activate the second motor and cause it to rotate the required number of steps for the day of the month reading so as to correspond at all times to the day counter contents and therefore be in agreement with the reading of a perpetual calendar.

2. Prior Art

Such watches are known and one such watch is described in detail in U.S. Pat. No. 4,300,222. The watch disclosed in the above document comprises a perpetual calendar that displays the day of the month by means of a rotary disc and, possibly, the day of the week by means of another disc.

Whereas the state, or the contents, of the day counter of the watch are given by the numerical value displayed by the day of the month display means, the state of month counter, which corresponds to the ordinal number of the month, remains however unavailable to the user. This information can only be obtained at the factory by using suitable equipment. This is a major drawback. Indeed, the possibility of ascertaining the contents of the month counter would provide the bearer of the watch with means for checking the correct operation of the calendar and, when this is not the case, for determining by how many units the counter must be corrected. This correction can for instance be done with the day of the month display means, since whenever these display means and the day counter go through 1 the contents of the month counter are modified by one unit.

SUMMARY OF THE INVENTION

An ojbect of the invention is to overcome this drawback by providing a watch wherein the day of the month display means are used to display, in addition to the date, the state of the month counter in response to actuation of a month call unit.

To this end, the electronic watch provided by the invention comprises:

a time-keeping circuit able to generate a time base signal;

a first motor activatable by said time base signal;

analogue hour-display means arranged to be driven by said first motor;

means for deriving from the time base signal a daily signal at the end of each day;

a perpetual calendar circuit comprising day, month and year counters connected in series and activatable by the daily signal, means for setting, in response to the state of the month and year counters, at the end of each month of less than 31 days, the day counter to the state that corresponds to the first day of the following month, and means for generating, at the end of each month, an end of month signal providing the complement to 31 of the state of the day counter;

a second motor;

analogue day of the month display means arranged to be driven by the second motor;

a control circuit for the second motor able to issue to the latter, in response to the daily signal and to the end of month signal, a first control signal enabling it to change the day of the month display by one day at the end of 31-day months and, at the end of less-than-31-day months, by the number of days corresponding to the end of month signal;

call means for generating a month calling signal; and a reading circuit connected to the day and month counters and able to issue to the second motor, in response to the call signal, a second control signal representative of the gap between the states of these two counters that enables the day of the month display means to be set in a position in which the number shown is the number of the month, and then a third control signal, also representative of the gap between the states of the two counters, that enables the day of the month display means to revert to a position in which the number displayed is the number of the day.

BRIEF DESCRIPTION OF THE DRAWINGS

In the accompaying drawings, given by way of example.

DETAILED DESCRIPTION

Figure 1:
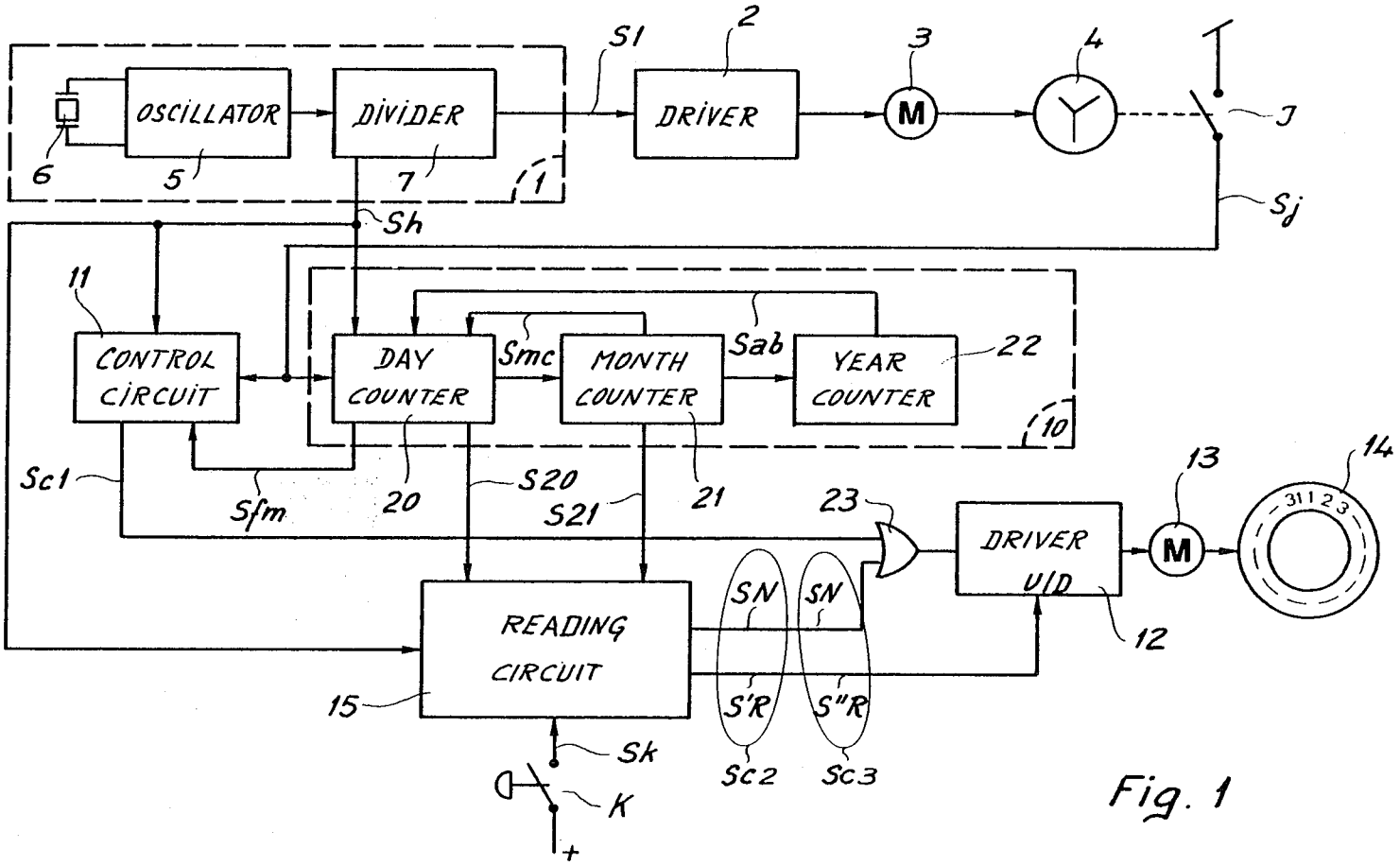
FIG. 1 is a diagram of an embodiment of the watch according to the invention.

The illustrated arrangement comprises a time-keeping circuit 1 which issues a time base signal S1 to a drive circuit 2. Drive circuit 2 then generates an activating signal to a first motor 3 causing it to rotate. Motor 3 drives the hands of analogue hours, minutes and seconds display means 4 and actuates, once a day, a daily contact J which generates a daily signal Sj.

Time-keeping circuit 1 comprises an oscillator 5 whose frequency is stabilized by a quartz resonater 6. Oscillator 5 issues a signal of e.g. 32768 Hz to a frequency divider 7 which issues on a first output a signal S1 and, on a second output, a clock signal Sh of approximately 10 Hz, made up of a series of pulses.

The components described so far form a conventional quartz analogue watch wherein time base signal S1 drives the first motor, which is preferably of the stepping type, forward at the rate of one step per second and hence the seconds hand of display means 4 at the same rate. The time setting of the watch is done by known correction means, not shown.

The illustrated arrangement further comprises a perpetual calendar circuit 10, a control circuit 11, a second drive circuit 12, a second motor 13, also preferably of the stepping type, having two directions of rotation, day of the month display means 14 that may be driven in either direction by motor 13 with for instance the aid of a Maltese cross, and a reading circuit 15 responsive to a call unit K, e.g. a contact which can be actuated from outside the watch to generate a signal Sk.

Perpetual calendar circuit 10 comprises three counters connected in series, i.e. a 5-bit day counter 20 counting by 31, a 4-bit month counter 21 counting by 12, and a 2-bit year counter 22 counting by 4. Day counter 20 receives, on its main input, daily signal Sj, on a second input, clock signal Sh, and issues, at the beginning of each month, a monthly signal to the input of month counter 21 which in turn issues at the beginning of each year a yearly signal to year counter 22. On one output of counter 20 and on one output of counter 21 are respectively issued signals S20 and S21 that are representative of the state, or the contents, of the counters. Counter 21 further issues a signal Smc indicating short months, i.e. of less than 31 days, and counter 22 issues a signal Sab indicating the leap year in a 4-year cycle.

Signals Smc and Sab are applied to two inputs of day counter 20 which is so designed that, in response to these signals, its contents go high when proceeding from a short month to the following month. In this way, the contents of counter 20 are constantly in agreement with the day of the month indications of a perpetual calendar.

Counter 20 also issues an end of month signal Sfm representing the complement to 31 of its contents at the end of each short month. This signal may for instance be made up of a series of pulses and include one pulse from clock signal Sh at the end of a 30-day month, two pulses at the end of a 29-day month and three pulses at the end of a 28-day month.

Control circuit 11 receives signals Sj, Sfm and Sh and generates, from these signals, a first, day of the month, control signal Sc1 for driving second motor 13. Signal Sc1 includes one pulse from clock signal Sh at the end of a 31-day month, two pulses at the end of a 30-day month, three pulses at the end of a 29-day month, and four pulses at the end of a 28-day month. Signal Sc1 is applied to the input of second drive circuit 12 via an OR gate 23 whereby day of the month display means 14 may be moved by motor 13 by 1 day at the end of a 31-day month, by 2 days at the end of a 30-day month, by 3 days at the end of a 29-day month and by 4 days at the end of a 28-day month.

Circuits 10 an 11 will not be described here since they are well known and one such circuit is disclosed in detail in U.S. Pat. No. 4,300,222 mentioned above.

Reading circuit 15 further enables whenever required motor 13 to be controlled by drive circuit 12 whereby day of the month display means 14 may be set in a position where they will show the ordinal number of the current month.

To this end, circuit 15 receives clock signal Sh and signals S20 and S21. Signal 20, being representative of the state of day counter 20, provides current day ordinal number Nj. Similarly, signal S21 provides current month ordinal number Nm. From this information circuit 15 generates, in response to recall signal Sk, a second, month control signal Sc2, for activating second motor 13 whereby day of the month display means 14 may be moved to a position where they will show the ordinal number of the month. This involves moving display means 14 by N=Nm−Nj days in a direction determined by the sign of N. After the second control signal, reading circuit 15 generates a third, reversing control signal, Sc3, serving to move day of the month display means 14 by the same number of days N as before, but in the opposite direction, whereby display means 14 may again show the ordinal number of the current day. Signals Sc2 and Sc3 are of course defined only during the call of the month, and if this call is performed while the calendar changes from one day to the next, day of the month control signal Sc1 must be delayed until display means 14 resumes its normal position.

Signal Sc2 is made up of signal SN and of a signal S'R. The first signal is applied to the input of second drive circuit 12 via OR gate 23 and enables day of the month display means 14 to be moved by N days by motor 13. The second signal is a logic signal applied to an up-down input, referenced U/D, of circuit 12. This signal determines, depending on its logic level, the direction of rotation of motor 13. Drive circuit 12, which is well known, will not be described here.

Signal Sc3 is made up of signal SN and of a signal S"R. This latter signal is issued by the same output of circuit 15 as signal S'R and determines also the direction of rotation of motor 13.

Figure 2:
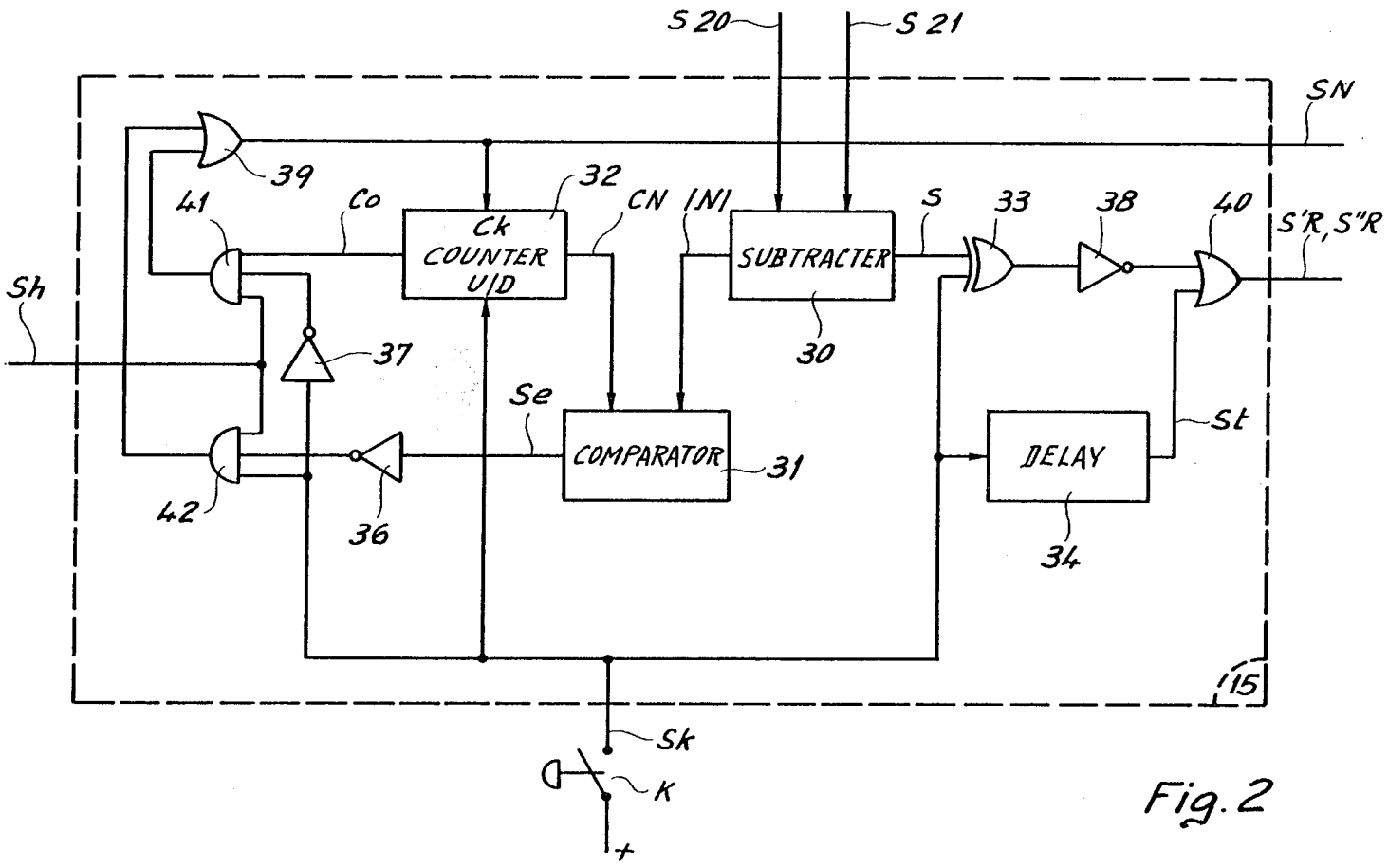
FIG. 2 illustrates schematically an embodiment of a part of FIG. 1.

A form of embodiment of reading circuit 15 will now be described with reference to FIG. 2. This circuit comprises a subtractor 30, a comparator 31, a forward-/backward counter by 31 referenced 32, an exclusive OR gate 33 and a delay element 34. Three inverters 36, 37 and 38, two OR gates 39 and 40 and two AND gates 41 and 42 further serve to direct the signals.

Subtractor 30 receives on its input signals S20 and S21 from day and month counters 20 and 21 respectively and issues on one output a signal giving the absolute value of N, referenced /N/, corresponding to the difference Nm−Nj, and on another output a logic signal S for indicating the sign of N. It will be assumed that a positive sign corresponds to the state where S is high and a negative sign where it is low. Signal /N/ is a 5-bit signal, able to have values 0, 1, 2 . . . 30, and is applied to one input of comparator 31.

Forward/backward counter 32 has a counting input Ck, which receives signal SN, and a U/D input which receives signal Sk whose logic level defines the counting mode, forward or backward. It will be assumed that the closing of contact K causes Sk to go high, thus corresponding to a forward count. The contents of counter 32 are given by a 5-bit output signal CN able to have values 0, 1, 2 . . . 30. Counter 32 also issues a logic signal Co whose level is determined by the contents of the counter. It will be assumed that Co is low when CN=0, and high when CN is not zero. It will be further assumed that when the cell is fitted into the watch, while contact K is open, counter 32 is reset by a signal not shown.

Comparator 31 receives signal /N/ on one input and signal CN on another input, and issues on its output a logic signal Se which is low when /N/ and CN are different and high when /N/ and CN are equal.

Reading circuit 15 further receives clock signal Sh. This signal is gated by gates 39, 41 and 42, with gates 41 and 42 being controlled by logic signals Sk, Se and Co, to produce signal SN. For this purpose, AND gates 42 and 42 have three inputs, with one input of each of these gates receiving signal Sh. A second input of AND gate 42 receives signal Sk and a second input of AND gate 41 receives signal Sk via inverter 37. The third input of AND gate 42 receives signal Co and the third input of AND gate 42 receives signal Se via inverter 36.

Signal SN appears on the output of two-input OR gate 39, one of its inputs being connected to the output of AND gate 41 and its second input being connected to the output of AND gate 42.

It will be assumed that the watch is initially in a mode for which day of the month display means 14 indicates the day of the month. Counter 32 is then reset and contact K open. Under these conditions signals Co and Sk are low. This inhibits signal Sh from going through one of AND gates 41 and 42 and reaching OR gate 39. Signal SN thus includes no pulse from signal Sh and circuit 12 receives only control signal Sc1 from circuit 11. Signals S'R and S''R are then high, as described further on, forcing motor 13 to rotate forward to cause day of the month display means 14 to move forward at the end of a day.

In order to set the watch in the mode that will enable the number of the month to be read on day of the month display means 14, contact K must be closed and maintained in this position during the reading.

Signal Sk then goes high. This firstly causes AND gate 42 to open to signal Sh since signal Se is still low and, secondly, causes the output signal of inverter 37, which is applied to one input of AND gate 41, to go low to prevent signal Sh from going through this gate, whatever the logic level of signal Co. Finally signal Sk sets counter 32 in the foward counting mode.

Signal SN thus includes the pulses of signal Sh, the latter going through AND gate 42 and OR gate 39. Each pulse of this signal moves day of the month display means 14 by one day and increments counter 32 by one unit starting from zero. After N pulses of signal SN, the contents of counter 32 will be equal to N and day of the month display means 14 will have moved by N days. Therefore, after N pulses, CN=/N/. Comparator 31, upon detecting this identity, causes signal Se to go high, thereby preventing signal Sh from going through AND gate 42 from then on.

If N is positive, day of the month display means 14 is moved forward. Thus, to indicate the month of November when day of the month display means 14 displays number 6, display means 14 is moved forward by 11−6=5 days. If N is negative, display means 14 is of course moved in the opposite direction. Display means 14 will indicate the number of the month so long as contact K remains closed.

Display means 14 reverts to indicating the day of the month when contact K is opened. Since signal Sk then goes low, AND gate 42 stops signal Sh, whatever may be the logic level of signal Se. On the other hand, the signal on the output of inverter 37, that is applied to one input of AND gate 41, goes high. This gate then allows signal Sh to go through since signal Co is at that time also high. The opening of contact K also causes counter 32 to switch to the backward counting mode. Signal SN thus includes pulses from signal Sh. Each pulse causes counter 32 to be decremented by one unit and display means 14 to be moved by one day in a direction opposite to that in which they moved when contact K was closed, as will be described below.

After N pulses of signal SN, the contents of counter 32 switch from N to zero and signal Co goes low, thus closing AND gate 41 to signal Sh. Day of the month display means 14 will therefore have performed, in response to contact K having been opened, N steps in a direction that will have caused them to return to the position they were in before contact K was closed.

The direction of rotation of motor 13 is defined by the logic levels of signals S'R and S''R. These signals in turn depend on the levels of signals S and Sk in the following manner: signal S'R must be identical to signal S when Sk is high, whereas signal S''R must be the opposite to signal S when Sk is low. It should be noted that S'R is not defined when Sk is low, nor is S''R when Sk is high.

Signals S'R and S''R are obtained from the output of two-input OR gate 40, one input being connected to the output of inverter 38. Inverter 38 is connected to the output of exclusive OR gate 33 which receives signal S on one input and signal Sk on the other. Under these conditions, the signal on the output of inverter 38 is identical to S if Sk is high, and opposite to S if Sk is low, in accordance with the definition of signals S'R and S''R.

Beside the time when contact K is closed, the U/D input of circuit 12 must be high for first control signal Sc1 to be able to drive day of the month display means 14 forward in a normal way to show the date. This condition is achieved by means of delay element 34, of known construction, whose input receives signal Sk and whose output issues a logic signal St to the second input of OR gate 40. Normally, signal St is high and thus transfers this high level to the U/D input of circuit 12, whatever the level of the signal on the output of inverter 38.

From the instant when contact K is closed, signal St goes low and remains low as long as the ordinal number of the month is being read. After contact K is opened, signal St still remains low for the length of time that is needed for display means 14 to return to their initial position. Signal St then reverts to high and remains high until contact K is closed again.

Reading circuit 15 described above has the advantage of being simple in structure. However, the switch from reading the number of the day to reading the number of the month is not performed systematically in a manner involving the least amount of movement and the motor must be of a type operating in two directions of rotation. Consequently, the time needed for the number of the month to be displayed and the consumption of the motor are both greater than need be, and drive circuit 12 needs to be more complex than in the case of a motor with only one direction of rotation.

These are the drawbacks which may be avoided by incorporating into circuit 15, in addition to the means for determining N=Nm−Nj, means for determining N'=31−/N/ and means for comparing N with N'. These means are of known construction and will not be described here as they are available to the man of the art.

For display means 14 to be able to display the month number with the least amount of movement, the use of a motor having two directions of rotation is inevitable. When N is positive, display means 14 must be moved by N days in the forward direction. But when N is negative, display means 14 must be moved by N days in the backward direction when the absolute value of N is smaller than N', and by N' days in the forward direction when N is greater than N'. The switch back to the number of the days is always performed in a direction opposite to that in which display means 14 had to be moved to display the number of the month.

The use of a motor having only one direction of rotation for displaying the month may prove to be of interest in a cheap watch. When N is positive, display means 14 must be moved foward by N days to display the month, then by N' days to revert to displaying the day. When N is negative, display means 14 must be moved forward by N' days to display the month, then by N days to revert to its initial position.

The number of the year in a 4-year cycle, which cycle corresponds to the periodic return of a leap year, could also be displayed in response to a call signal of the year in the same way as the number of the month. To this end, subtractor 30 should simply receive, in response to the call signal of the year and using switching means not shown, a signal representative of the contents of year counter 22, instead of signal S21.

The calendar watch described above may of course be modified in various ways within the scope of the appended claims.

We claim:

1. An electronic watch which comprises:

a time-keeping circuit able to generate a time base signal;

a first motor activatable by said time base signal;

analogue hour-display means arranged to be driven by said first motor;

means for deriving, from said time base signal, a daily signal at the end of each day;

a perpetual calendar circuit comprising day, month and year counters connected in series and activatable by the daily signal, means for setting, in response to the state of the month and year counters, at the end of each month of less than 31 days, the day counter to the state that corresponds to the first day of the following month, and means for generating, at the end of each month, an end of month signal providing the complement to 31 of the state of the day counter;

a second motor;

analogue day of the month display means arranged to be driven by said second motor;

a control circuit for said second motor able to issue to the latter, in response to the daily signal and to the end of month signal, a first control signal enabling it to change the day of the month display by one day at the end of 31-day months and, at the end of less-than-31-day months, by the number of days corresponding to the end of month signal;

call means for generating a month calling signal; and a reading circuit connected to said day and month counters and able to issue to said second motor, in response to said call signal, a second control signal representative of the gap between the states of these two counters that enables the day of the month display means to be set in a position in which the number shown is the number of the month, and then a third control signal, also representative of the gap between the states of said counters, that enables the day of the month display means to revert to a position in which the number displayed is the number of the day.

2. A watch as in claim, further comprising means for generating a year call signal and a switching circuit, that is connected to the month and year counters, for issuing to the reading circuit, in response to the month call signal, a signal representative of the state of the month counter and, in response to said year call signal, a signal representative of the state of the year counter, and wherein said reading circuit generates, in response to said year call signal, a fourth control signal representative of the gap between the state of the year counter and the state of the day counter which enables the day of the month display means to be set in a position where the number displayed is the number of the year in a 4-year cycle, and then a fifth control signal, also representative of the gap between the states of said counters, which enables the day of the month display means to be returned to a position in which the number displayed is the number of the day.

3. A watch as in claim 1, wherein said daily signal is generated by an electrical contact actuated once a day by the hour display means.

4. A watch as in claim 1, wherein the reading circuit comprises:

a subtractor connected to the day and month counters and able to generate a signal representative of the gap, N, between the states of said counters, and a signal representative of the sign of said gap;

a forward/backward counter for counting the number of steps performed by the second motor and for generating a signal representative of this number and a logic signal indicating the zero state of this counter;

a comparator arranged to receive the output signals issued by said subtractor and said forward/backward counter and able to generate a logic signal which assumes one logic level when the signals are different, and another level when the signals are equal; and a logic circuit able to generate from the signals issued by said subtractor, by said forward/backward counter and by said comparator, from the month call signal and from a clock signal made up of pulses, said second and third control signals, each of these two control signals being made up of a signal that includes the number of clock signal pulses needed to actuate the day of the month display means and of a logic signal for determining the direction in which said display means are actuated.

5. A watch as in claim 4, wherein said reading circuit further comprises means for determining the complement, N', to 31 of N, means for comparing N with N' and means for generating control signals enabling the day of the month display means to be actuated, in response to the month signal, by:

N days in the forward direction, which correspond to an increase in the number of the day, when N is positive, N days in the opposite direction when N is negative and has an absolute value less than N', and N' days in the forward direction when N is negative and greater than N' whereby the display of the month's number will always be achieved with the least amount of movement by said display means from their normal day-number display condition.

* * * * *

UNITED STATES PATENT AND TRADEMARK OFFICE

CERTIFICATE OF CORRECTION

PATENT NO. : 4,733,384

DATED : March 22, 1988

INVENTOR(S) : PIERRE-ANDRE MEISTER, et al.

It is certified that error appears in the above-identified patent and that said Letters Patent is hereby corrected as shown below:

Column 7, claim 2, line 1, after "as in claim", insert --1--.

Signed and Sealed this

Second Day of August, 1988

*Attest:*

*Attesting Officer*

DONALD J. QUIGG

*Commissioner of Patents and Trademarks*